US005184186A

United States Patent [19]

Kida

[11] Patent Number: 5,184,186

[45] Date of Patent: Feb. 2, 1993

[54] MOTOR CONTROL FOR AN AUTOMATIC DOCUMENT CONVEYING APPARATUS

[75] Inventor: Yasuhiko Kida, Osaka, Japan

[73] Assignee: Mita Industrial Co., Ltd., Osaka, Japan

[21] Appl. No.: 767,638

[22] Filed: Sep. 30, 1991

[30] Foreign Application Priority Data

Sep. 29, 1990 [JP] Japan ..... 2-261870

[51] Int. Cl.[5] ..... G03G 15/00 F

[52] U.S. Cl. ..... 355/321; 271/256; 355/309

[58] Field of Search ..... 355/308, 309, 316, 321, 355/312, 314, 313, 320; 271/258, 259, 256

[56] References Cited

U.S. PATENT DOCUMENTS

| | | | |
|---|---|---|---|
| 3,751,158 | 8/1973 | Komori | 355/310 X |
| 3,893,662 | 7/1975 | Boyd | 355/309 X |
| 4,066,255 | 1/1978 | Bradbury | 271/265 |
| 4,169,674 | 10/1979 | Russel | 355/309 |
| 4,372,668 | 2/1983 | Malachowski et al. | 355/317 |
| 4,492,455 | 1/1985 | Kawai | 355/309 X |
| 4,864,365 | 9/1989 | Ito | 355/311 X |
| 5,027,162 | 6/1991 | Kida et al. | 355/320 |

FOREIGN PATENT DOCUMENTS

| | | |
|---|---|---|
| 0333140 | 9/1989 | European Pat. Off. . |
| 0363807 | 4/1990 | European Pat. Off. . |

*Primary Examiner*—A. T. Grimley
*Assistant Examiner*—Nestor R. Ramirez
*Attorney, Agent, or Firm*—Cushman, Darby & Cushman

[57] ABSTRACT

An automatic document conveying apparatus and method for use with an image forming device such as a photocopying machine. The apparatus comprises a document feeder for feeding documents into the apparatus, a document conveyor for conveying documents to a copying position on the photocopying machine, and a document reconveyor section for re-conveying documents back to the copying position and also for conveying documents out of the apparatus. The apparatus further comprises a controller for controlling operation of the feeder, conveyor and reconveyor. The controller controls the feeding motor which drives the document feeder and the conveying motor which drives the document conveyor such that the feeding motor is driven during operation while the conveying motor is turned OFF and ON. Hence, rush current travels to the conveying motor during on/off operation and not to the feeding motor during continuous ON operation thus reducing the load imposed on the power supply and eliminating the need for a delay time between starting of the respective motors.

2 Claims, 6 Drawing Sheets

MOTOR CONTROL FOR AN AUTOMATIC DOCUMENT CONVEYING APPARATUS

BACKGROUND OF THE INVENTION

1. Field of the Invention:

The present invention relates to an automatic document conveying apparatus for use with an image forming apparatus, such as a photocopy machine having a document reading portion on which a document is put.

2. Description of Related Art

FIGS. 1*a* and 1*b* (both prior art) show a conventional automatic document conveying apparatus 1 mounted on an electrostatic-photographic copying machine. The automatic document conveying apparatus 1 is provided with document conveyor 4 for leading/discharging a document into/from a document reading portion 3 (contact glass) provided at an upper portion of a copying machine body 2, document feeder 5 provided at the document lead-in portion of the document conveyor 4, and reconveyor 6, provided adjacent to the discharging end of the document conveyor 4 in the document discharging direction, to convey-out and reconvey-in the document.

The document feeder 5 comprises a guide plate 8 provided near an end of an inclined document feeding stand 7 closest to the document conveyor 4 to help position the document and a document mover 9 provided above the guide plate 8. The document feeder 5 further comprises a first feeder 10 such as feeding rollers or the like, disposed adjacent to the document mover 9 at a location nearer to the document conveyor 4, and being able to feed the document at the top of a stack of documents on the document feeding stand 7 toward the document conveyor 4 while preventing any of the remaining documents from being fed toward the document conveyor 4 at the same time, and a second feeder 11 comprising rollers or the like, disposed adjacent to the first feeder 10 nearer to the document conveyor 4, to feed the document to the document conveyor 4 at a predetermined time. The document feeder 5 is driven by a feeding motor 28.

The document conveyor 4 comprises a plurality of conveying rollers 12 which are disposed in a housing 13 at predetermined intervals in the document feeding/discharging direction, and a wide endless belt 14 wound on the conveying rollers 12. Although the document conveyor 4 is not illustrated in detail, the document conveyor 4 is driven by a conveying motor 29.

Further, the reconveyor 6 comprises a pair of plates (not shown) projecting along the sides of the reconveying means in the conveying/reconveying direction, a document conveying roller 15 having an axis of rotation substantially perpendicular to the side plates, a first conveying path 17 for guiding the document discharged from the document reading portion 3 around the document conveying roller 15 and for conveying the document to a first document receiving tray 16 provided above the document reading portion 3, and a second conveying path 19 branching off from the first conveying path 17 to guide the document to a second document receiving tray 18. The reconveying means further comprises a first switching claw 20, disposed at the branching position of the first and second conveying path, for switching feeding of the document to the first document receiving tray 16 or the second document receiving tray 18, a reconveying path 21 branching off from the first conveying path 17 to guide the document which has passed the first switching claw 20 back to the document reading portion 3, a second switching claw 22, disposed at the branching position of the first conveying path and reconveying path, for switching feeding of the document to the first document receiving tray 16 or the reconveying path 21, and a feeding roller 23 disposed proximate to the branching position of the first conveying path and reconveying path to be in contact with the circumferential surface of the document conveying roller 15.

The reconveyor 6 may be driven by the conveying motor 29 which drives the document conveyor 4 or may be driven by a different motor (not shown).

Reference numerals 24, 25 and 26 designate first, second and third switches, respectively. The first switch 24 detects the presence of a document on the document feeding stand 7 and is disposed proximate to the end of the document feeding stand 7 closest to the document conveyor 4 thus turning on when the document is present. The second switch 25 detects the presence of a document fed by the original feeding means 5 toward the document conveyor 4 and is disposed proximate to the document conveying means thus turning on when the document is present. The third switch 26 detects whether a document is discharged onto the first document receiving tray 16 and is disposed proximate to a discharging outlet 27 thus turning on when the document passes.

Therefore, by switching the first switching claw 20, a document discharged from the document reading portion 3 can be fed selectively to the first conveying path 17 or the second conveying path 19. Also, by switching the second switching claw 22, a document fed to the first conveying path 17 can be fed selectively to the first document receiving tray 16 or the reconveying path 21.

In the conventional automatic document conveying apparatus, a controller 30 controls the operation of the feeding motor 28 and the conveying motor 29 such that the respective times that the feeding motor 28 and the conveying motor 29 are turned on are shifted slightly to prevent overlapping of rush currents of the motors thereby reducing the possibility of overloading the power source.

Referring to a flowchart shown in FIG. 2 (prior art), the above-mentioned conventional control will be described.

It is assumed that one copy of each document of a plurality of documents is made. To begin, the copying machine set to an automatic document feeding mode, and the number of sheets to be copied for each document (one in this case) is entered on a ten-key keypad (not shown).

When a plurality of documents are mounted on the document feeding stand 7, the first switch 24 (labeled SW1 in FIG. 2) is turned on (YES in step S1) and then the operation continues to step S2. Then, when a start-key (not shown) is turned on (YES in step S2), the feeding motor 28 (labeled FM in FIG. 2) for driving the document feeder 5 is turned on and a first timer (labeled T1 in FIG. 2) starts counting (step S3).

When the feeding motor 28 is turned on, the document mover 9 rotates in a predetermined direction to come in contact with the uppermost one of the documents setting on the document feeding stand 7 to send the document toward the first feeder 10.

When the first timer finishes counting a predetermined time (YES in step S4), a first feeder 10 is turned on, and a second timer (labeled with T2 in FIG. 2) starts counting (step S5). When the feeding clutch (labeled FCL in step S5) is turned on, the first feeder 10 rotates in a predetermined direction to send the first document toward the second feeder 11. At this time, since the second feeder 11 is stopped, an edge of the first document contacts the second feeder 11 so that slanted movement of the document is corrected. When the second timer finishes counting a predetermined time (YES in step S6), the feeding clutch is turned off (step S7). The first feeding wherein the document is sent to and stopped at the second feeder 11 through the steps S5–S7 is thus completed.

Upon the completion of the first feeding, the conveying motor 29 (labeled CM in FIG. 2) for driving the document conveyor 4 is turned on, and a clutch (labeled RCL in FIG. 2) provided in the second feeder 11 is turned on (step S8), so that the endless belt 14 and the second feeder 11 start to rotate in predetermined directions, respectively.

When the second feeder 11 rotates in the predetermined direction, the first document is sent toward the document conveyor 4. When the forward edge of the first document passes the second switch 25 (labeled SW2 in FIG. 2), second switch 25 is turned on (YES in step S9), and a third timer (labeled T3 in FIG. 2) starts counting (step S10).

When the third timer finishes counting a predetermined time (YES in step S11), the conveying motor 29 is turned off, the clutch is also turned off, so that the first document is aligned with a predetermined reference position in the document reading portion 3. Thus, the second feeding operation of the document is completed. At this time, predetermined copying operations such as exposure, development, fixing, etc. are performed in the copying machine body 2, and a copy of the first document is output from the copying machine body 2 (step S12).

Since the plurality of documents remain on the document feeding stand 7, the first switch 24 is turned on (YES in step S13) and the feeding clutch is turned on, so that the second timer starts to count (step S14). When the second timer finishes counting a predetermined time (YES in step S15), the feeding clutch is turned off (step S16), so that the first feeding operation for a second document is performed. That is, although the first feeding operation is performed in steps S14 through S16 similarly to steps S5 through S7, the first feeding operation in steps S14 through S16 is performed simultaneous with the predetermined copying operations being performed in the copying machine body 2.

Next, the feeding motor 28 is turned off (step S17), and a document exchange signal (labeled CHANGE in FIG. 2) is supplied from the copying machine body 2 (YES in step S18), so that it is determined whether the second document is waiting in contact with the second feeder 11 (step S19). Since the second document is waiting in the above state, the operation proceeds to step S20 where the feeding motor 28 is turned on and a fourth timer (labeled T4 in FIG. 2) starts to count. When the fourth timer finishes counting a predetermined time (YES in step S21), the operation returns to step S8 to repeat the second feeding operation.

When copying of the last document is completed (step S12), there is no document on the document feeding stand 7, and the first switch 24 is turned off (NO in step S13), the first feeding operation is not performed, and the feeding motor 28 is also turned off (step S17). Although a document exchange signal is supplied from the copying machine body 2 (YES in step S18) so that the operation proceeds to step S19, no document is waiting at the second feeder 11, and the operation therefore proceeds to step S22.

When the conveying motor 29 is turned on (step S22) to convey the last document toward the discharging outlet 27, the third switch 26 provided in the vicinity of the discharging outlet 27 is turned on so that the rear edge of the last document is detected (YES in step S23), the conveying motor 29 is turned off (step S24), and the last document discharges onto the first document receiving tray 16.

As described above, the conventional automatic document conveying apparatus 1 has several disadvantages. For example, when the feeding motor 28 and the conveying motor 29 are turned on upon the exchanging operation, through the use of the fourth timer (T4), the conveying motor 29 is turned on several milliseconds after feeding motor 28 so that peaks of rush currents due to the starting of the motors do not overlap each other. However, the time required for exchanging documents is prolonged by the time corresponding to the delay in starting the conveying motor 29, and when using a high-speed machine, this time increase becomes significant as the number of documents becomes large. Although attempts to shorten the delay time have been made, the peak current values increase as the delay time decreases thus rendering these attempts unsuccessful.

SUMMARY OF THE INVENTION

The present invention has been designed in view of the matters described above, and an object thereof is to provide an automatic document conveying apparatus in which the time required for exchanging documents is made shorter than that in the conventional apparatus while the load imposed on the power source is reduced.

According to the present invention, an automatic document conveying apparatus is provided on an upper portion of a copying machine body 2. A document feeding unit for feeding a document toward a document reading portion formed on the copying machine body 2 is driven by a feeding motor 28, while a document conveying unit provided on the document reading portion for leading and discharging the document into and from the document reading portion is driven by a conveying motor 29, such that while the image on each document is copied on one sheet (i.e., one copy sheet per document), the feeding motor 28 is always driven and the conveying motor 29 is turned on/off in accordance with a control signal produced from the controller 30 disposed in or about the copying machine body 2.

According to the present invention, when copying is performed, the feeding motor 28 is always turned on, while the conveying motor 29 is turned on/off in accordance with control signals provided by controller disposed in the copying machine body 2. Hence, rush current is generated only in the conveying motor 29. Thus, reducing the load imposed on the power source. Furthermore, unlike the conventional apparatus, no time delay is necessary before turning the conveying motor 29 on. Therefore, the time required for exchanging documents is reduced.

DETAILED DESCRIPTION OF THE PREFERRED EMBODIMENT

Figure 1A:
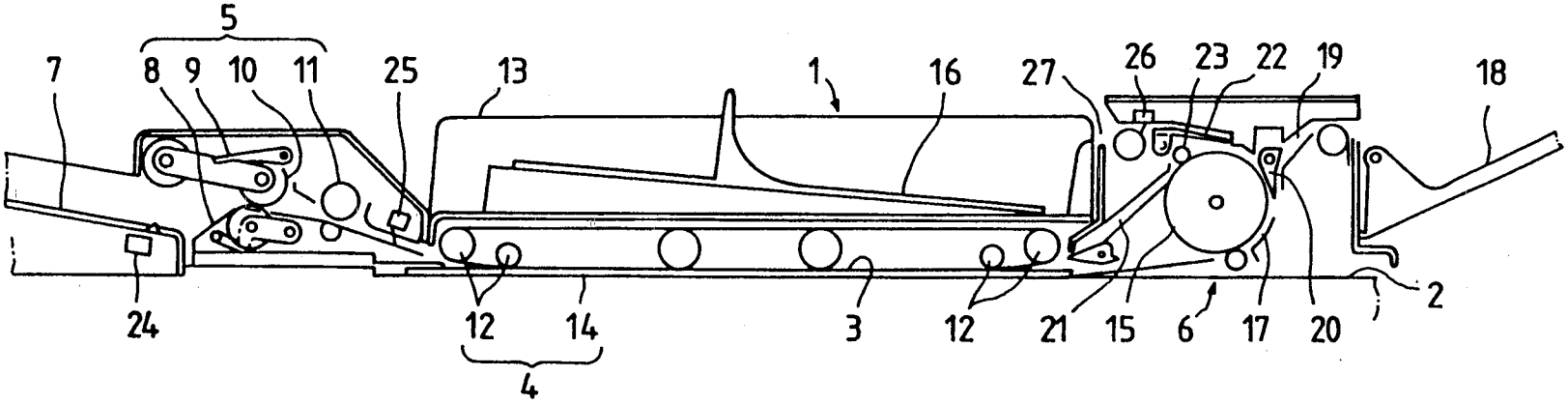
FIG. 1a (PRIOR ART)
FIGS. 1*a* and 1*b* (both prior art) are side views showing the outline of the conventional automatic document conveying apparatus.
Figure 1B:
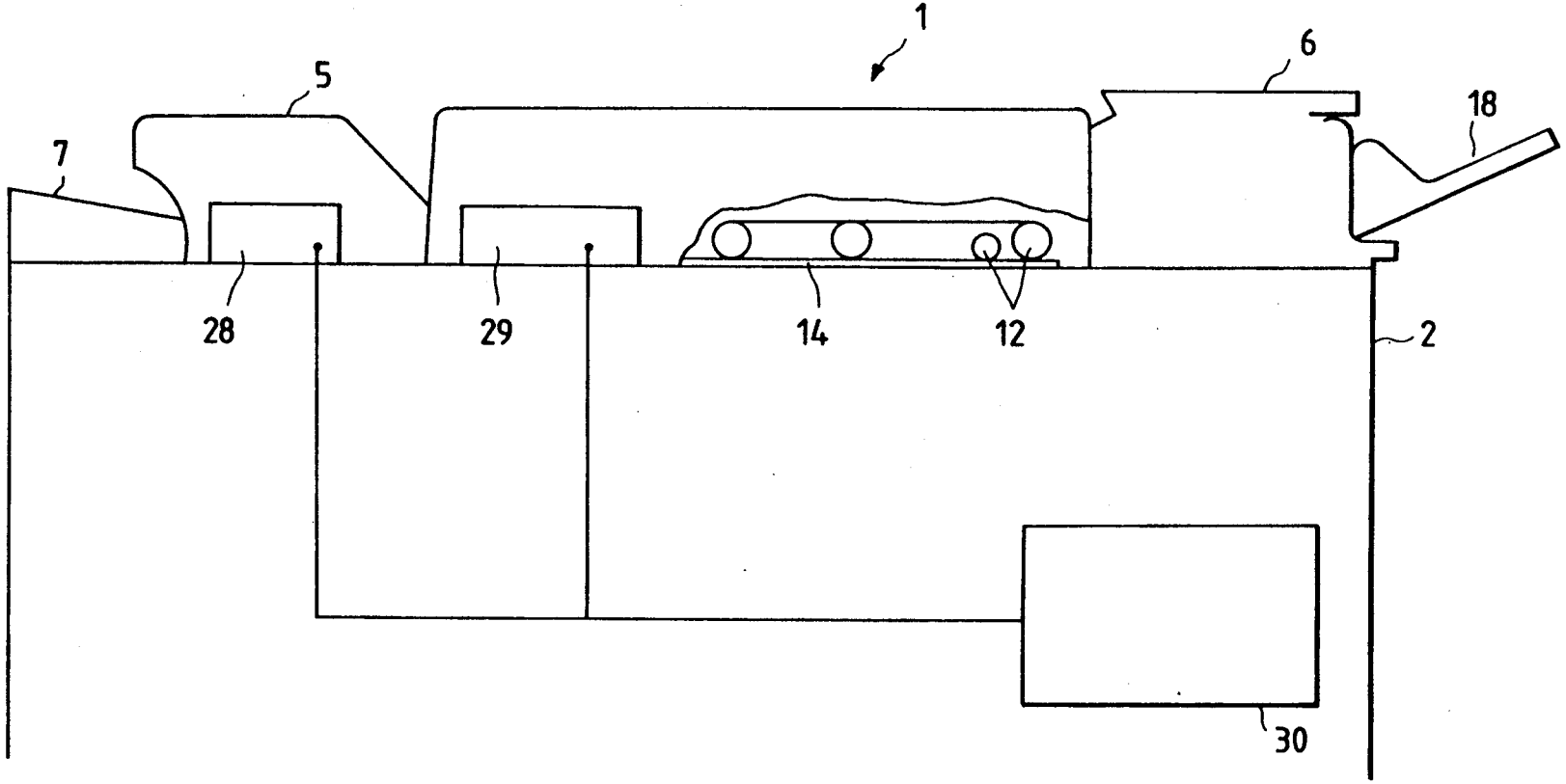
FIG. 1b (PRIOR ART)

Referring to the drawings, embodiments of the present invention will now be described.

The automatic document conveying apparatus according to the present invention does not differ in mechanical structure from the conventional apparatus but provides an improved method for controlling operation of the apparatus.

In an automatic document feeding mode, a control signal DFPRE is supplied from the controller 31 disposed in the copying machine body 2 to the automatic document conveying apparatus 1 only in the case where one copy is made of each document, and the conveying motor 29 is turned on/off in accordance with this signal. The automatic document conveying apparatus 1 implements FLAG 1 and FLAG 2 such that FLAG 1 becomes "1" when the first feeding operation is being performed and becomes "0" when the first feeding is not performed, and FLAG 2 becomes "1" when the feeding motor 28 is turned on and becomes "0" when the feeding motor 28 is turned off.

Figure 2:
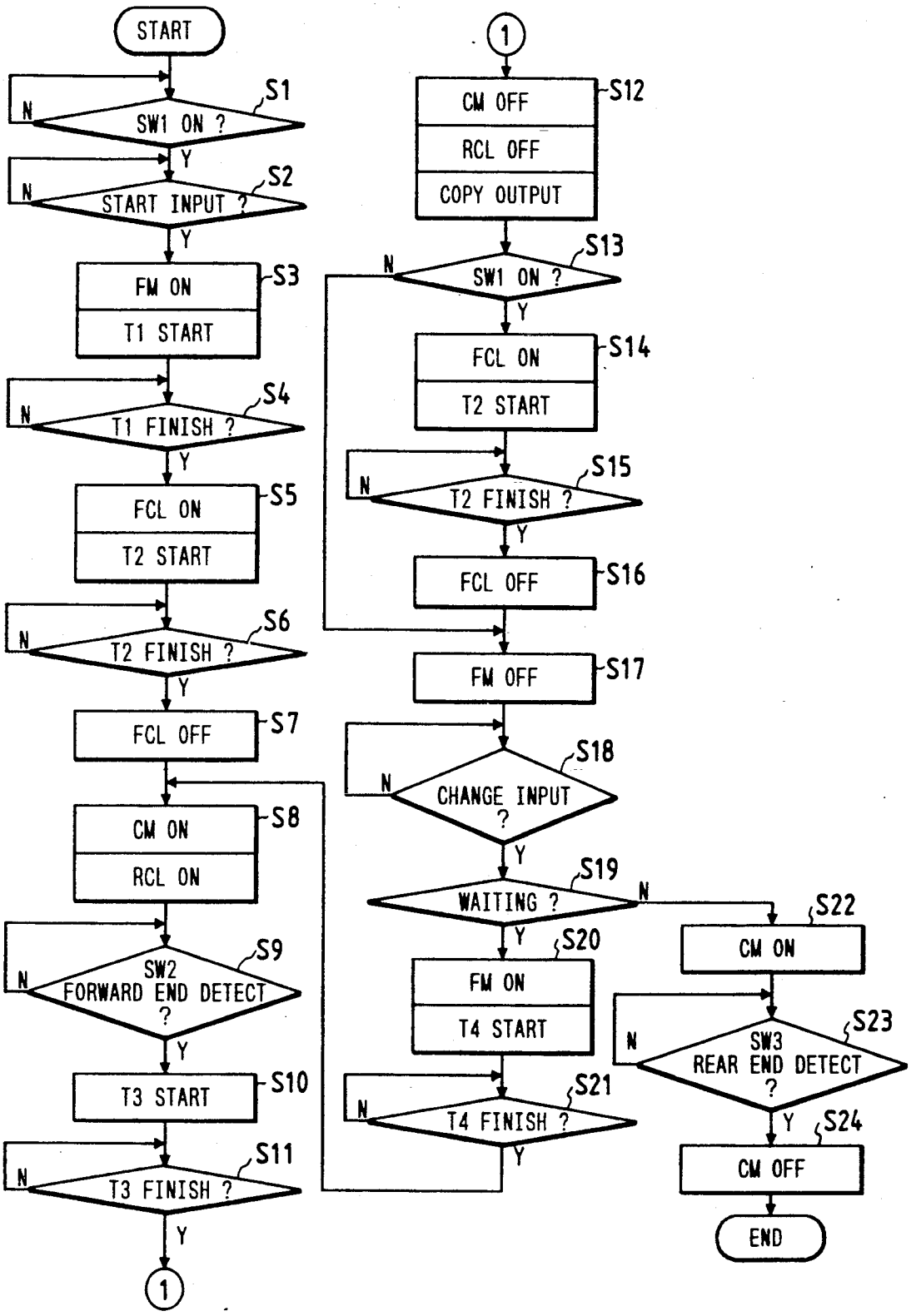
FIG. 2 (prior art) is a flowchart illustrating the steps of the conventional automatic document conveying operation.
Figure 4:
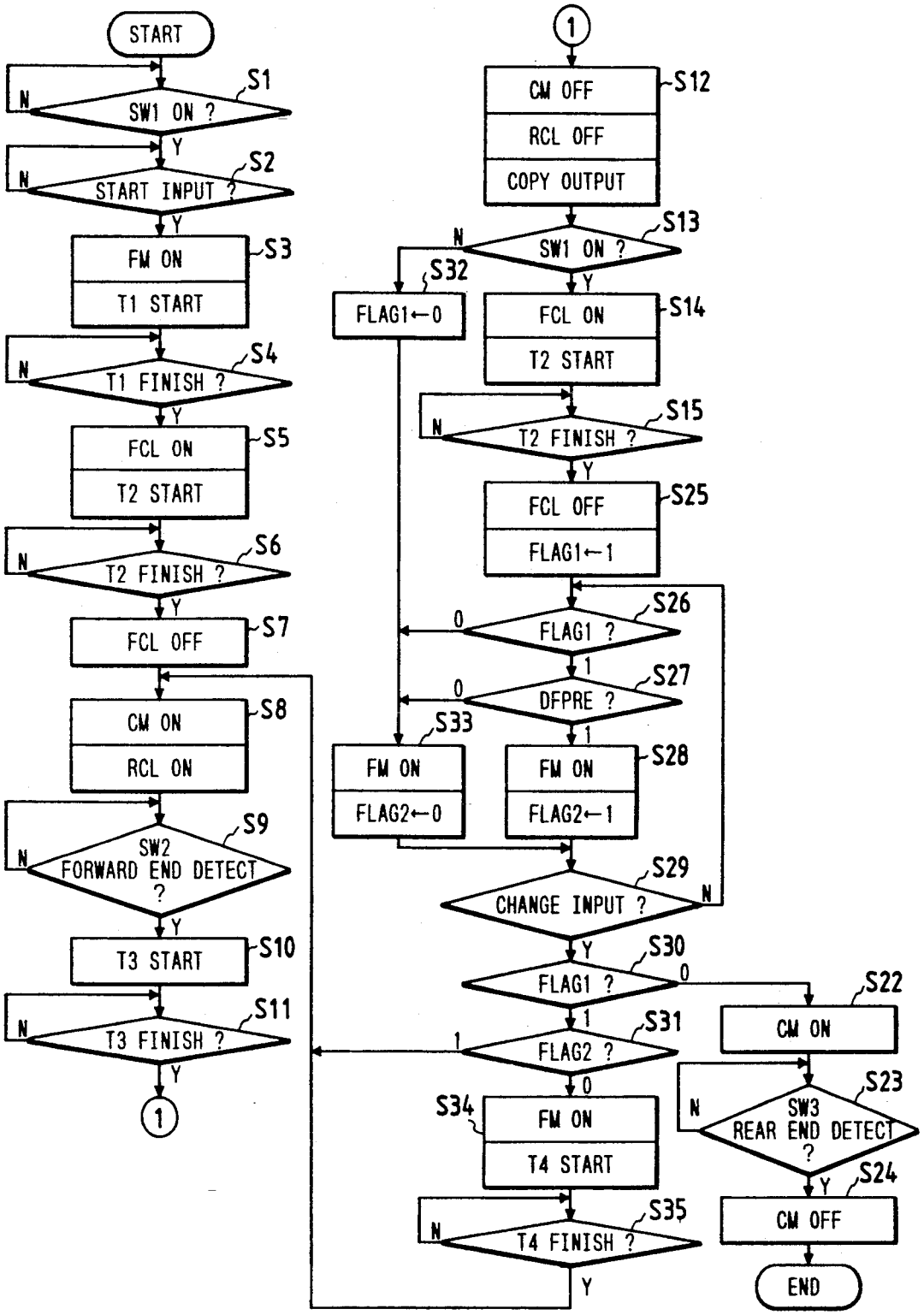
FIG. 4 is a flowchart illustrating steps of the automatic document conveying operation in the present invention.
Figure 5B:
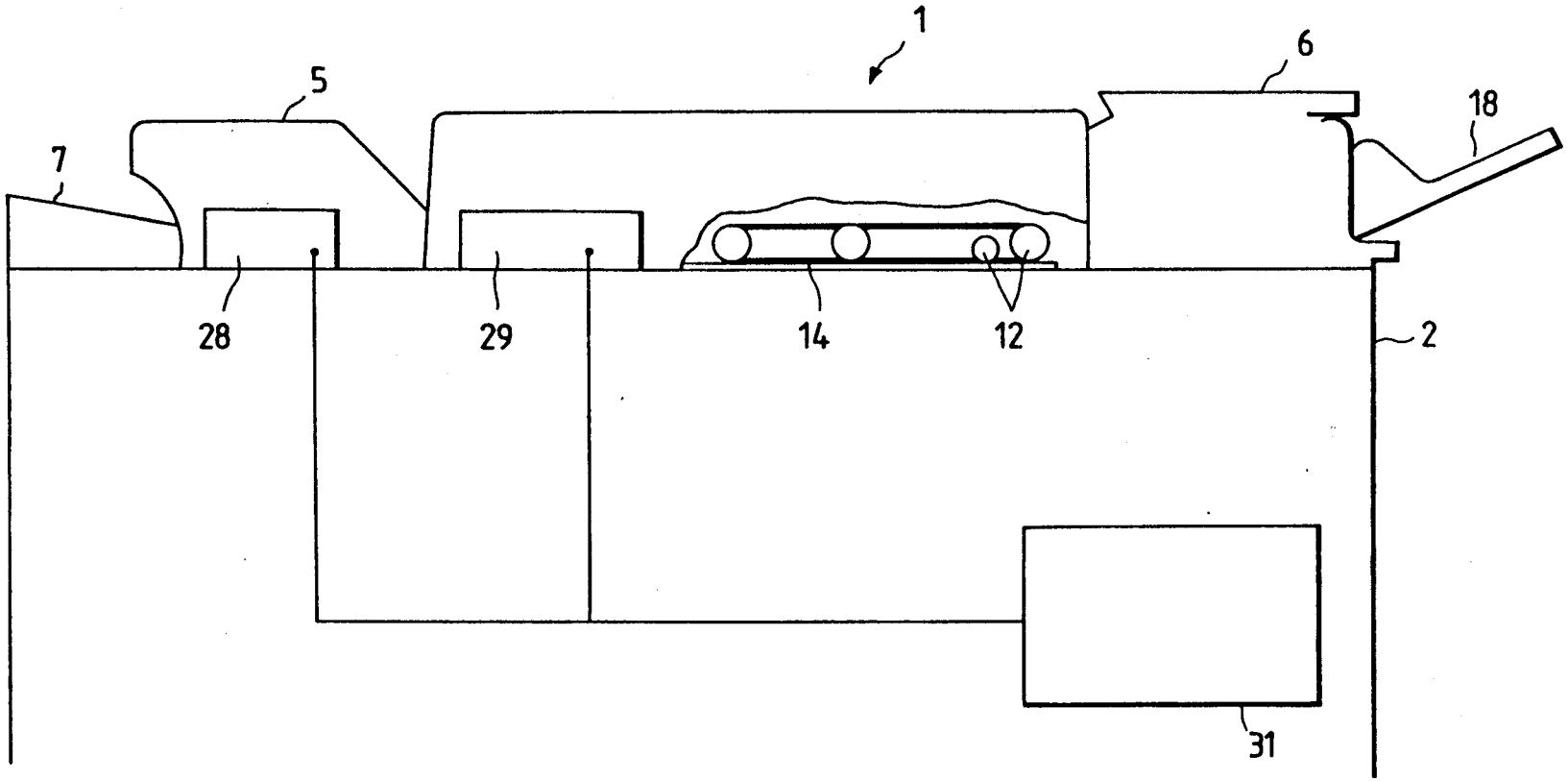

A flowchart shown in FIG. 4 illustrates the operating steps of the invention as they are controlled by controller 31. In FIG. 4, the steps identical to those shown in FIG. 2 are correspondingly referenced, and the description of these steps is omitted.

In the case that one copy for each of the documents is made, when a plurality of documents are mounted on the document feeding stand 7, the first switch 24 is turned on (YES in step S1) and then the operation proceeds to step S2. Then, when a start-key (not-shown) is activated (YES in step S2), the feeding motor 28 is turned on and the first timer starts counting (step S3).

When the feeding motor 28 is turned on, the document mover 9 rotates in a predetermined direction to come in contact with the uppermost one of the documents setting on the document feeding stand 7 to send the document toward the first feeder 10. When the first timer finishes counting a predetermined time (YES in step S4), the feeding clutch provided on the first feeder 10 is turned on, and the second timer starts counting (step S5).

When the feeding clutch is turned on, the first feeding means 10 rotates in a predetermined direction to send the first document toward the second feeder 11. At this time, since the second feeder 11 is stopped, an edge of the first document contacts the second feeder 11 so that slanted movement of the document is corrected. When the second timer finishes counting a predetermined time (YES in step S6), the feeding clutch is turned off (step S7), thus completing the first feeding.

Upon the completion of the first feeding, the conveying motor 29 for driving the document conveyor 4 is turned on, and at the same time the clutch RCL is turned on (step S8), so that the endless belt 14 and the second feeder 11 start to rotate in predetermined directions, respectively.

When the second feeder 11 rotates in the predetermined direction, the first document is sent toward the document conveyor 4. When the forward edge of the first document passes second switch 25, second switch 25 is turned on (YES in step S9), and the third timer starts counting (the step S10).

When the third timer finishes counting a predetermined time (YES in step S11), the conveying motor 29 is turned off, and the clutch RCL is also turned off, so that the first document is in alignment with a predetermined reference position in the document reading portion 3. Thus, the second feeding operation of the document is completed. At this time, predetermined copying operations such as exposure, development, fixing, etc. are performed in the copying machine body 2, and a copy of the first document is output from the copying machine body 2 (step S12).

Since the plurality of documents remain on the document feeding stand 7, the first switch 24 is turned on (YES in step S13) and the feeding clutch is turned on, so that the second timer starts to count (step S14). When the second timer finishes counting a predetermined time (YES in step S15), the feeding clutch is turned off (step S25) so that the first feeding operation for a second document is performed. That is, although the first feeding operation is performed in steps S14, S15 and S16 similarly to steps S5 through S7, the first feeding operation in steps S14 through S26 is performed simultaneous with the copying operations being performed in the copying machine body 2.

The above operations are same with those in the prior art.

According to the present invention, however, the first feeding operation for a second document is being performed at this time, and the FLAG 1 is set to "1" (step S25). Then, the operation proceeds to step S27. Also, because one copy is to be made for each document in the above case, DFPRE signal has been sent from the copying machine body 2 to the automatic document conveying apparatus 1 (DFPRE ="1") so the operation then proceeds to step S28. At this time, since the feeding motor 28 is still on, the FLAG 2 becomes "1" (step S28).

Next, since a document exchange signal (change input ="y") has been supplied at this time, the operation proceeds to step S30 and since FLAG 1 is "1", the operation proceeds to step S31. Here, since FLAG 2 is "1", the operation returns to step S8. From the step S8, the steps of the second feeding operation and succeeding therefrom are repeated.

When the last document is completely copied (step S12), no documents remain on the document feeding stand 7, and the first switch 24 is turned off ("NO" in step S13). Accordingly, the first feeding operation is not performed, FLAG 1 becomes "0" (step S32), the feeding motor 28 is stopped, FLAG 2 becomes "0" (the step S33), and the operation proceeds to step S29. Since the document exchange signal has been supplied in step S29 (change input ="y"), the operation proceeds to step S30.

Because FLAG 1 is "0" in step S30, the operation proceeds to step S22, and the conveying motor 29 (CM) is turned on (step S22). When the last document is conveyed toward the discharging outlet 27 and the third switch 26 detects the rear edge of the last document (YES in step S23), the conveying motor 29 is turned off (step S24), and the last document is discharged onto the first document receiving tray 16.

Figure 3:
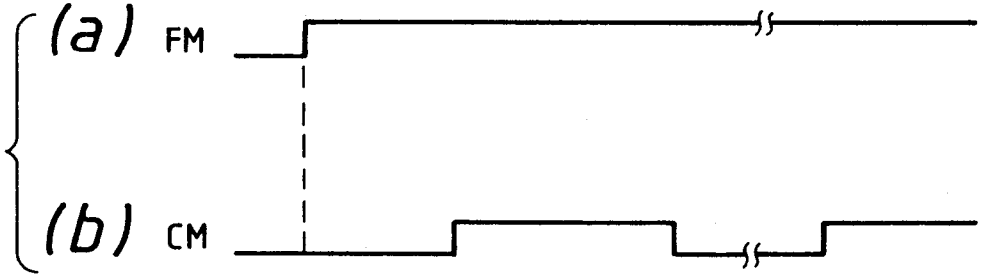
FIG. 3 is a time-chart showing the on/off timings of the feeding motor and the conveying motor of the present invention.
Figure 5A:
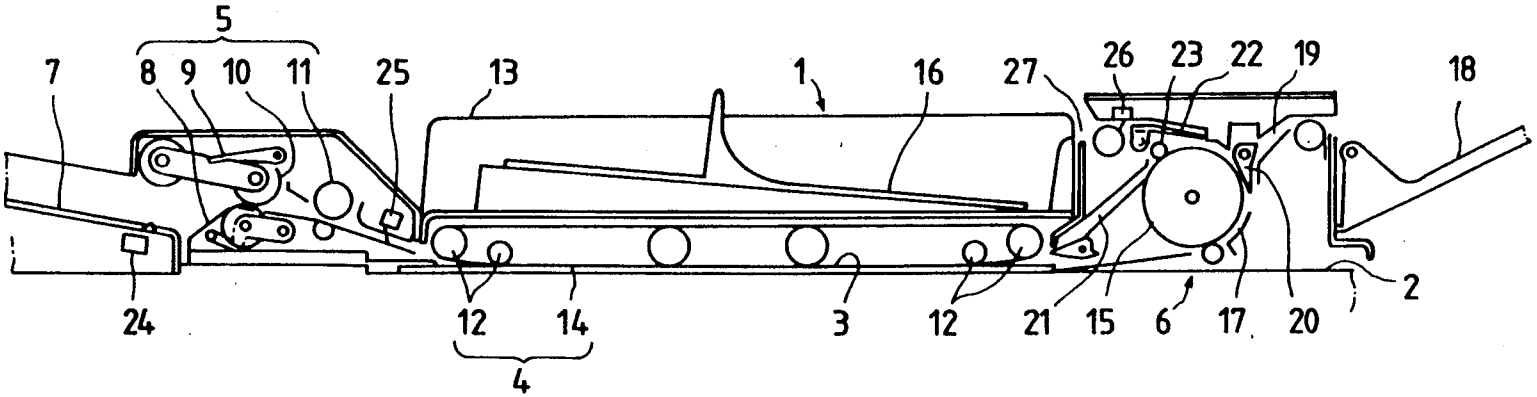
FIGS. 5*a* and 5*b* are side views showing the outline of the automatic document conveying apparatus of the present invention.

According to the above description, when one copy is made of each document, the feeding motor 28 (FM) is always turned on (driven) as shown in FIG. 3(*a*), while the conveying motor 29 (CM) is turned on/off in accordance with a control signal supplied from the copying machine body 2 as shown in FIG. 3(*b*). Accordingly, rush current flows only into the conveying motor, and therefore the load imposed on the power source is reduced. Unlike the conventional copies, when the conveying motor 29 is turned on, no delay (T4) is necessary; thus, the time required to exchange documents is reduced.

In the case that multiple copies for each of the documents are made, the DFPRE provided by the controller 31 is set to "0" so that, at step S13, the operation proceeds to step S33. Accordingly, the feeding motor 28 is turned off, and FLAG 2 becomes "0" (step S33). Further, when the first copying operation for the first document is completed, the document exchange signal is not supplied (change input ="N"), thus, the operation returns to step S26. Upon completion of the last copy of the first document, the document exchange signal is supplied (change input ="y") and the operation then proceeds to step S30.

At step S30, since the first feeding operation is being performed as described above, FLAG 1 is set to "1". Accordingly, the operation proceeds to step S31. At step S31, FLAG 2 is set to "0", and the operation proceeds to steps S34.

At step S34, the feeding motor 28 is turned on, and the fourth timer starts counting (step S34). When the fourth timer finishes counting a predetermined time (YES in step S35), the operation returns to step S8 and the steps of the second feeding operation are repeated. Then, a plurality of copies are made for each of the remaining documents.

When all copies of the last document have been made (step S12), no documents remain on the document feeding stand 7 and thus the first switch 24 is turned off (NO in step S13). Accordingly, the primary feeding operation is not performed, FLAG 1 becomes "0" (step S32), the feeding motor 28 is turned off, FLAG 2 becomes "0" (step S33), and the operation proceeds to step S29. When the original exchange signal is supplied in step S29 (change input ="y"), the operation continues to step S30.

Since FLAG 1 is "0" in step S30, the conveying motor 29 is turned on in step S22. When the last document is conveyed toward the discharging outlet 27 so that the third switch 26 detects the rear edge of the last document (YES in step S23), the conveying motor 29 is turned off (step S24), and the last document discharges onto the first document receiving tray 16.

The present invention reduces the load imposed on the power source, in addition to reducing the time required for exchanging the documents which therefore reduces the copying time. Hence, the present invention is effective in a high-speed copying machine.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims. For example, in addition to photocopying machines the invention can be used with other image forming apparatus such as facsimile machines, optical character reader (OCR) scanning machines, etc.

What is claimed is:

1. An automatic document conveying apparatus for use with an image forming apparatus, comprising:

means for temporarily storing a plurality of documents;

means for feeding the documents individually from the storing means;

first motor means for driving the feeding means;

means for conveying the documents individually to a predetermined position of the image forming apparatus, the image forming apparatus forming an image of each of the documents at the predetermined position;

second motor means for driving the conveying means;

means for ejecting the documents individually from the automatic document conveying apparatus; and means, responsive to signals from the image forming apparatus, for controlling the first motor means to continuously operate to continuously drive the feeding means while operating the second motor means in predetermined on and off manner until the image forming apparatus has formed the image of said each of the documents stored in the storing means, said controlling means preventing the first motor means and the second motor means from being started simultaneously.

2. A method for controlling an automatic document conveying apparatus for use with an image forming machine, comprising the steps of:

temporarily storing a plurality of documents in a document storing device; and performing the following steps until the image forming device forms an image of each of the documents stored in the document storing device:

controlling a first motor, in accordance with control signals provided by a controller, to continuously drive a feeder during operation of the automatic document conveying apparatus to feed the documents individually from the document storing device into the automatic document conveying apparatus;

controlling a second motor, in accordance with control signals provided by the controller, to drive a conveyor in a predetermined on and off manner during operation of the automatic document conveying apparatus to convey each of the documents individually to a predetermined position of the image forming apparatus, the image forming apparatus producing the image of said each of the documents at the predetermined position;

preventing the first motor and the second motor from being started simultaneously; and removing said each of the documents individually from the automatic document conveying apparatus.

* * * * *